US007416387B2

(12) United States Patent
Lan et al.

(10) Patent No.: US 7,416,387 B2
(45) Date of Patent: Aug. 26, 2008

(54) FAN AND FAN FRAME THEREOF

(75) Inventors: Chung-Kai Lan, Taoyuan Hsien (TW); Huan-Chi Chen, Taoyuan Hsien (TW); Te-Tsai Chuang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/354,918

(22) Filed: Feb. 16, 2006

(65) Prior Publication Data

US 2007/0065281 A1 Mar. 22, 2007

(30) Foreign Application Priority Data

Sep. 22, 2005 (TW) ..... 94132766 A

(51) Int. Cl.
*F04D 29/54* (2006.01)

(52) U.S. Cl. ..... 415/211.2; 415/220

(58) Field of Classification Search ..... 415/211.2, 415/220, 221; 417/423.14
See application file for complete search history.

(56) References Cited

U.S. PATENT DOCUMENTS 1,742,510 A * 1/1930 Hubbell, Jr. ..... 415/121.3
2,228,116 A * 1/1941 Ilg et al. ..... 454/354
3,173,605 A * 3/1965 Harris ..... 415/207
6,844,641 B1 * 1/2005 Horng et al. ..... 310/89
7,011,496 B2 * 3/2006 Sun ..... 415/211.2
2004/0212262 A1 * 10/2004 Chui et al. ..... 310/91
2005/0002784 A1 * 1/2005 Li et al. ..... 415/220
2006/0039784 A1 * 2/2006 Yan et al. ..... 415/220
2007/0154308 A1 * 7/2007 Yang ..... 415/220

* cited by examiner

*Primary Examiner*—Edward Look
*Assistant Examiner*—Nathaniel Wiehe
(74) *Attorney, Agent, or Firm*—Birch, Stewart, Kolasch & Birch, LLP

(57) ABSTRACT

A fan includes a fan frame and an impeller. The fan frame has a housing, a base and at least one supporting element. The inner wall of the housing has at least one guiding portion in the form of a curved cavity for increasing an airflow intake of the fan, and the base is disposed within the housing and has a bottom portion and a pressurizing portion. The pressurizing portion is disposed around the bottom portion for increasing an air pressure of the fan. The supporting elements are connected to the housing and the pressurized portion of the base. The impeller is disposed within the housing and supported by the base.

19 Claims, 5 Drawing Sheets

FAN AND FAN FRAME THEREOF

CROSS REFERENCE TO RELATED APPLICATIONS

This Non-provisional application claims priority under U.S.C. § 119(a) on patent application No(s). 094132766, filed in Taiwan, Republic of China on Sep. 22, 2005, the entire contents of which are hereby incorporated by reference.

BACKGROUND OF THE INVENTION

1. Field of Invention

The invention relates to a fan and a fan frame thereof, and in particular to a fan and a fan frame thereof having functions of airflow pressurizing and guiding.

2. Related Art

An electronic element, such as a CPU (Central Processing Unit), is usually disposed in a housing in order to protect the electronic element from being contaminated by the dust in the air. However, the operating electronic element generates heat, which has to be dissipated. If the heat is not dissipated appropriately, the stability and efficiency of the electronic element tend to deteriorate, or even the electronic element may burn out. Thus, a fan is usually used to keep the electronic element to work normally within an operational temperature range.

FIG. 1 is an exploded view showing a conventional fan, and FIG. 2 is a cross-sectional view showing the fan of FIG. 1. Referring to FIGS. 1 and 2, a conventional fan 1 includes a fan frame 10 and an impeller 20. The fan frame 10 has a housing 11, a base 12 and a plurality of ribs 13. The base 12 is disposed in the middle of the housing 11. The ribs 13 are disposed between the housing 11 and the base 12 for supporting the base 12. The impeller 20 is disposed in the housing 11 and located on the base 12. A motor 14 is also disposed on the base 12. When the fan 1 rotates, the motor 14 drives the impeller 20 to rotate for producing an airflow and enforcing the airflow to flow toward the electronic element (not shown) so as to dissipate the heat of the electronic element.

However, the operation voltage and the working frequency of the electronic element are increased with the increasing of the processing speed of the electronic element, and the temperature of the electronic element is also greatly increased. Thus, the air pressure and the air quantity of the fan 1 have to be increased for achieving the sufficient heat dissipating effect. The cross-sectional area of the flowing fluid is a main reason of determining the air quantity. However, the housing 11 of the conventional fan 1 has a uniform aperture. In other words, the cross-sectional area of an inlet 15 of the housing 11 is equal to the cross-sectional area of an outlet 16 of the housing 11. Thus, the air pressure and the air quantity of the fan 1 are restricted and cannot be effectively increased.

To solve this problem, the prior art usually increases the operational efficiency of the fan 1 or enlarges the impeller 20 so as to increase the air quantity of the fan 1. However, increasing the operational efficiency of the fan 1 has to pay for the extra power cost. Besides, the inner temperature of the fan 1 is inevitably increased, and the lifetime of the fan 1 is thus shortened. Furthermore, enlarging the impeller 20 has to satisfy the precondition of the enlarged housing 11 for accommodating the enlarged impeller 20. However, the size of the housing 11 is often restricted by the limited space in the casing of the electronic element and thus cannot be increased arbitrarily.

Thus, it is an important subject of the invention to provide a fan and a fan frame thereof capable of effectively increasing the air pressure and the air quantity of the fan without adding the extra power and enlarging the size of the fan.

SUMMARY OF THE INVENTION

In view of the foregoing, the invention is to provide a fan capable of effectively increasing the air pressure and the air quantity, and a fan frame thereof.

To achieve the above, the invention discloses a fan frame including a housing, a base and at least one supporting element. An inner wall of the housing has at least one guiding portion in the form of a curved cavity. The base is disposed in the housing and has a bottom portion and a pressurizing portion disposed around the bottom portion. The supporting element is disposed between the housing and the pressurizing portion.

To achieve the above, the invention also discloses a fan including a fan frame and an impeller. The fan frame has a housing, a base and at least one supporting element. An inner wall of the housing has at least one guiding portion in the form of a curved cavity. The base is disposed in the housing and has a bottom portion and a pressurizing portion. The pressurizing portion is disposed around the bottom portion. The supporting element is disposed between the housing and the pressurizing portion of the base. The impeller is disposed in the housing and supported by the base.

In the fan and the fan frame stated hereinabove, the pressurizing portion has a free end and a connecting end opposite to the free end. The connecting end is connected to the bottom portion. The cross-sectional area of the free end is unequal to the cross-sectional area of the connecting end. For example, the cross-sectional area of the connecting end is larger than that of the free end. The housing has an inlet and an outlet. The connecting end of the pressurizing portion is substantially flushed with the outlet in order to adjust the output area of the airflow. Alternatively, the connecting end of the pressurizing portion sinks into and is disposed within the housing, and is located far from the outlet by a buffer depth. The cross section of the pressurizing portion is a tilted surface or a curved surface. The guiding portion is a slot or a curved cavity.

In addition, the housing further has at least one curved cavity, which is disposed on an outer sidewall of the housing. The curved cavity and the guiding portion may be disposed alternately. The supporting element is connected to the guiding portion, and the supporting element and the guiding portion coordinately form a continuously smooth curved shape. Alternatively, the supporting element and the guiding portion are disposed correspondingly and coordinately form a discontinuously curved shape. The supporting element is a rib or a stationary blade. The cross section of the housing substantially has a circular shape, an elliptic shape, a polygonal shape, a cone-like shape or other shapes. The housing, the bottom portion, the pressurizing portion, the guiding portion and the supporting element may be integrally formed as a single unit.

As mentioned hereinabove, the fan and the fan frame thereof according to the invention reduce the cross-sectional area of the outlet of the fan and increase the air pressure of the fan according to the pressurizing portion disposed around the bottom portion, and enlarge the space, through which the airflow produced by the impeller passes, smooth the airflow without turbulence, and thus increase the air pressure and the air quantity of the fan according to the guiding portion on the inner wall of the housing. Compared with the prior art, the fan and the fan frame thereof according to the invention can increase the air pressure and the air quantity of the fan and thus enhance the heat dissipating efficiency without enlarging the size of the fan.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
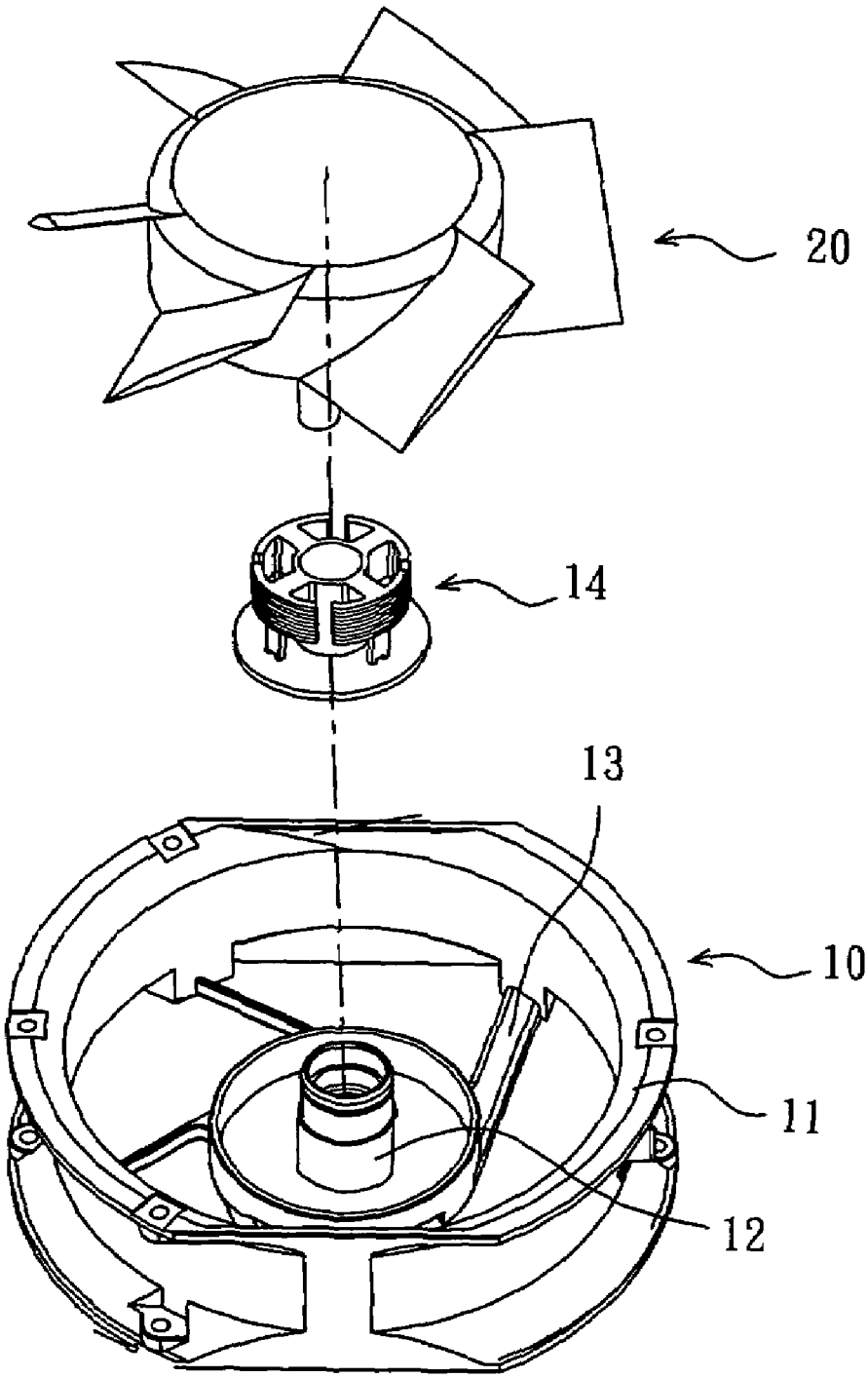
FIG. 1 ( PRIOR ART )
FIG. 1 is an exploded view showing the conventional fan.
Figure 2:
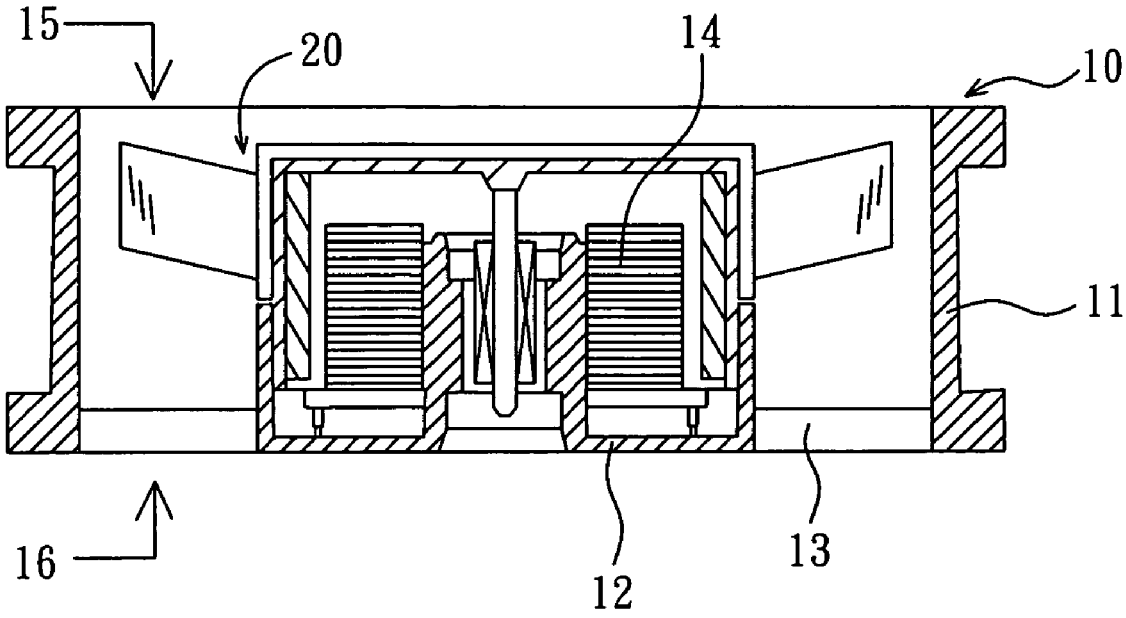
FIG. 2 ( PRIOR ART )
FIG. 2 is a cross-sectional view of the fan in FIG. 1.
Figure 3A:
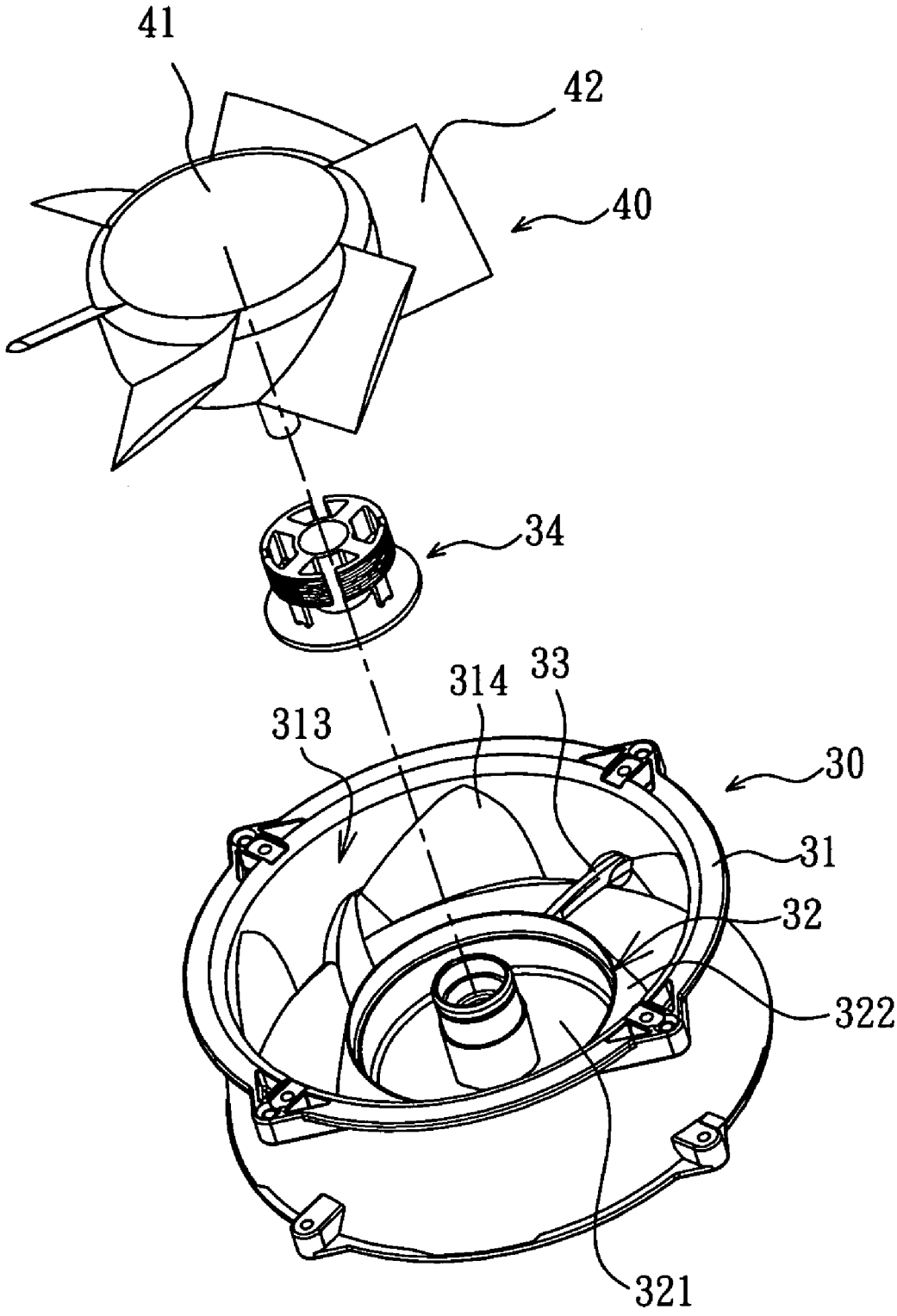
FIG. 3A is an exploded view of a fan according to a preferred embodiment of the invention.
Figure 3B:
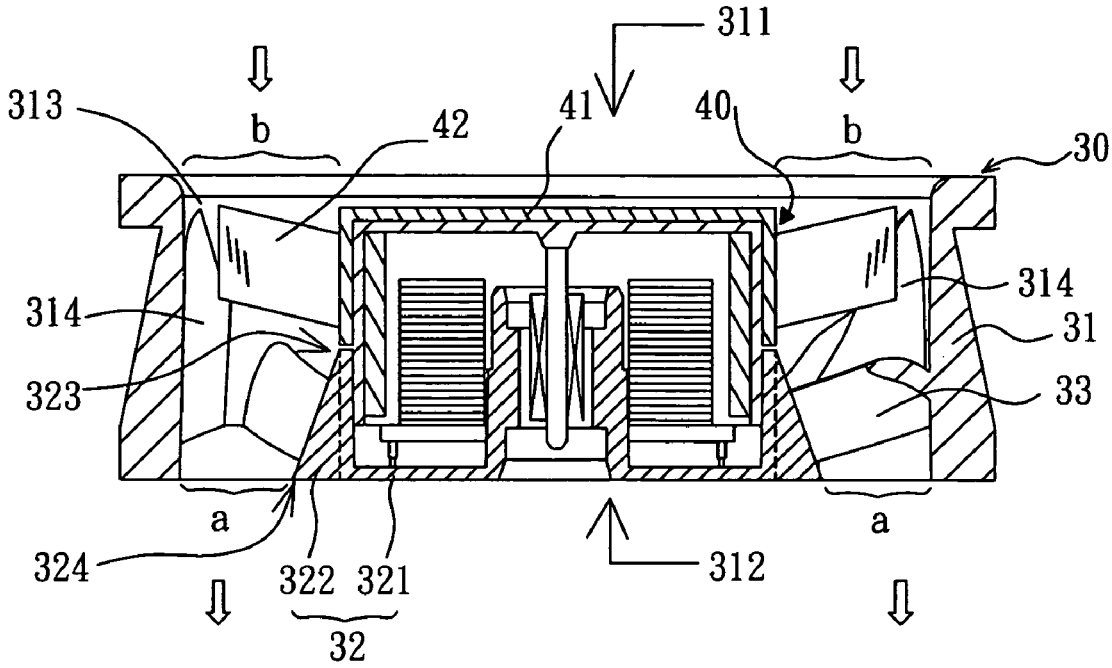
FIG. 3B is a cross-sectional view of the fan of FIG. 3A.
Figure 4:
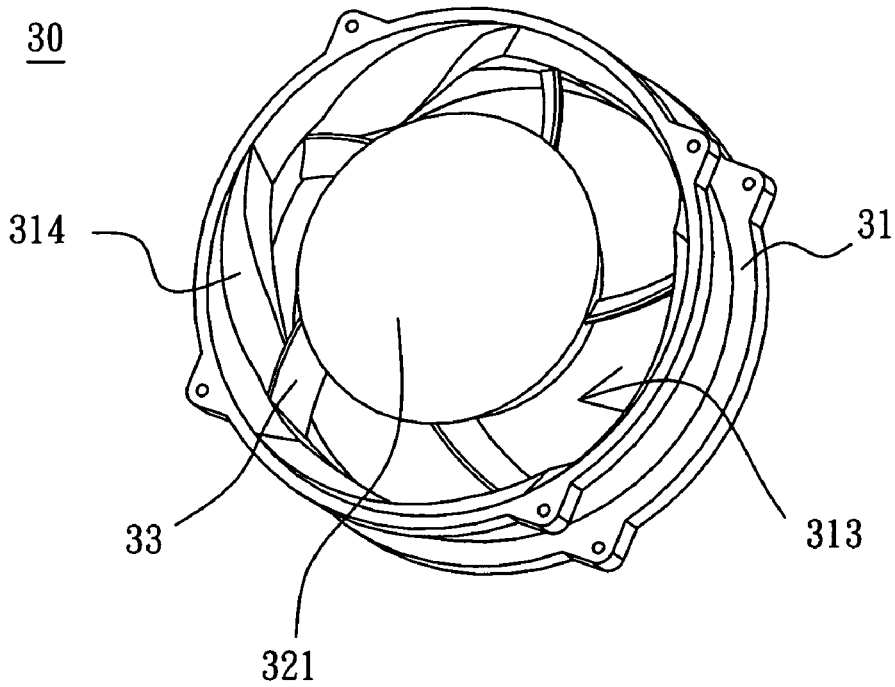
FIG. 4 is a schematic illustration of a fan frame in FIG. 3A.

FIG. 3A is an exploded view showing a fan according to a preferred embodiment of the invention, FIG. 3B is a cross-sectional view of the fan in FIG. 3A, and FIG. 4 is a schematic illustration of a fan frame in FIG. 3A. Referring to FIGS. 3A, 3B and 4, a fan 3 includes a fan frame 30, an impeller 40 and a driving device 34. The fan frame 30 has a housing 31, a base 32 and at least one supporting element 33. It is noted that the number of the supporting elements 33 is not particularly limited, and the number of the supporting elements 33 is five in this embodiment.

The base 32 is disposed in the housing 31, and the base 32 has a bottom portion 321 and a pressurizing portion 322 disposed around the bottom portion 321. A tube portion, in which a rotation shaft of the impeller 40 may be disposed, extends from a center of the base 32 and is perpendicular to the base 32. The driving device 34, which may be a motor disposed on the base 32, drives the impeller 40 to rotate and thus produce the airflow.

Referring to FIG. 3B, the pressurizing portion 322 has a free end 323 and a connecting end 324 opposite to the free end 323. The connecting end 324 is connected to the bottom portion 321. The cross-sectional area of the free end 323 is unequal to the cross-sectional area of the connecting end 324. In this embodiment, the cross-sectional area of the connecting end 324 is greater than the cross-sectional area of the free end 323.

Figure 5:
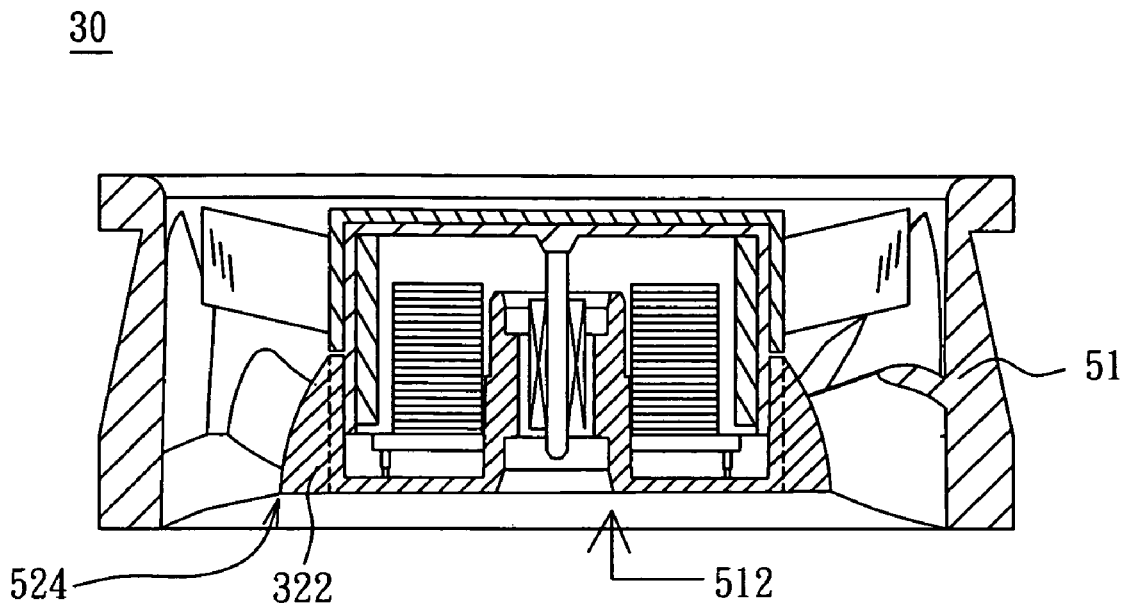
FIG. 5 is a schematic illustration showing another fan frame of the fan in FIG. 3A.

The housing 31 has an inlet 311 and an outlet 312. A passage 313 is formed between the inner wall of the housing 31 and the pressurizing portion 322. The connecting end 324 of the pressurizing portion 322 is substantially flushed with the outlet 312 of the housing 31 for adjusting an airflow intake. However, the connecting end 324 is not limited thereto. For example, as shown in FIG. 5, which is a schematic illustration showing another fan frame of the fan in FIG. 3A. A connecting end 524 of a pressurizing portion 522 may sink into and be disposed within a housing 51 and thus be located far from an outlet 512 by a buffer depth. In addition, the pressurizing portion 322 of FIG. 3B has, without limitation to, a tilted plane. As shown in FIG. 5, the pressurizing portion 522 may have a curved cross section. In addition, the cross section of each of the housings 31 and 51 may have a substantially circular shape, an elliptic shape, a polygonal shape, a cone-like shape or other shapes according to the actual product requirements.

The inner wall of the housing 31 (i.e., the circumference of the passage 313) of FIG. 4 has at least one guiding portion 314 in the form of a curved cavity. In this embodiment, a plurality of guiding portions 314 are disposed around the inner wall of the housing 31, and the guiding portion 314 is preferably a slot or a curved slot. The shape of the guiding portion 314 may be similar to a shape of a blade or a wing so as to enlarge the space of the passage 313 for containing more airflow. Thus, the output air quantity of the fan 3 may be increased.

Each of the supporting elements 33 may be a stationary blade or a rib, and is connected to the housing 31 and the pressurizing portion 322 of the base 32 so as to support the base 32. As shown in FIGS. 3A and 4, the supporting elements 33 are separately connected to the guiding portions 314, and each of the supporting elements 33 is connected to the corresponding guiding portion 314 and the corresponding pressurizing portion 322. Thus, the supporting element 33 and the guiding portion 314 coordinately form a continuously smooth curved structure for guiding the airflow produced by the rotating impeller 40 so that the output air quantity of the fan 3 may be increased. Furthermore, the continuously smooth curved structure coordinately formed by the supporting element 33 and the guiding portion 314 can reduce the wind resistance and noise.

Alternatively, the supporting elements 33 and the guiding portions 314 may also be disposed alternately such that the supporting elements 33 and the guiding portions 314 coordinately form a discontinuously curved shape as long as the structure is well designed to be able to obtain a good flow field. In addition, the housing 31, the bottom portion 321, the pressurizing portion 322, the guiding portions 314 and the supporting elements 33 may be integrally formed as a single unit according to the actual requirements. That is, the fan frame 30 may be a single piece.

The impeller 40 is disposed within the housing 31 and located on the base 32. The impeller 40 has a hub 41 and a plurality of blades 42 connected around the hub 41. The cross-sectional area of the hub 41 is substantially equal to the cross-sectional area of the free end 323 of the pressurizing portion 322, and the position of the hub 41 corresponds to that of the base 32. That is to say, the hub 41 and the bottom portion 321 are disposed with respect to the same shaft.

When the impeller 40 rotates, airflow enters the fan 3 from the inlet 311, passes through the passage 313, and then flows out of the fan 3 from the outlet 312. At this time, the aperture "a" of the output opening (the outlet 312) is smaller than the aperture "b" of the input opening (the inlet 311) because the cross-sectional area of the connecting end 324 of the pressurizing portion 322 is greater than the cross-sectional area of the free end 323. Thus, the effect of increasing the air pressure may be obtained. The housing 31 may be formed with a gradually enlarged passage 313 from the inlet 311 to the outlet 312 so that the air pressure may be further increased.

Figure 6:
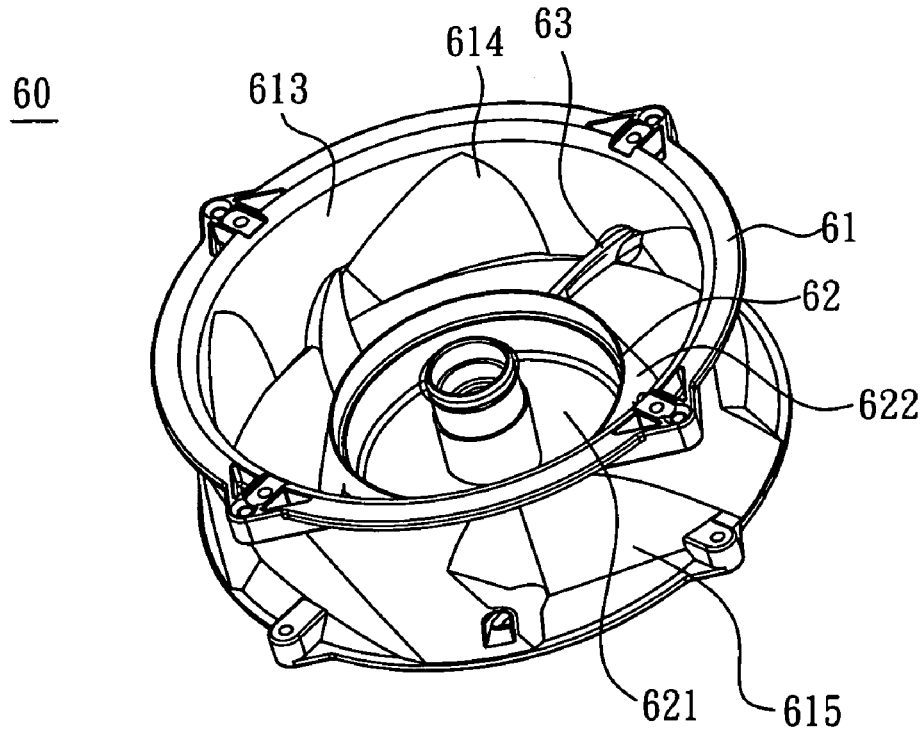
FIG. 6 is a schematic illustration showing still another fan frame of the fan in FIG. 3A.

In addition to the fan frame 30 disclosed in FIGS. 3A and 4, the fan 3 may also adopt another fan frame. FIG. 6 is a schematic illustration showing still another fan frame 60 of the fan in FIG. 3A. Referring to FIG. 6, the fan frame 60 has a housing 61, a base 62 and at least one supporting element 63. Similar to the fan frame 30, the base 62 of the fan frame 60 is disposed in the housing 61, and the base 62 has a bottom portion 621 and a pressurizing portion 622 disposed around the bottom portion 621. The inner wall of the housing 61, i.e., the circumference of a passage portion 613, has at least one guiding portion 614 in the form of a curved cavity, such as a slot or curved slot, and has a shape similar to the shape of the blade so as to enlarge the space of the passage portion 613. Thus, the space for containing the airflow can be enlarged, and the output air quantity of the fan can be increased.

The outer sidewall of the housing 61 further has at least one curved cavity 615. In this embodiment, the curved cavities 615 and the guiding portions 614 are disposed on the outer sidewall and the inner wall of the housing 61 alternately such that the thickness of the housing 61 approximates a constant thickness all over the housing 61. Thus, it is possible to prevent the housing 61 from deforming owing to the non-uniform thickness of the housing 61 during the manufacturing processes.

In summary, the fan of the invention reduces the cross-sectional area of the outlet of the fan and thus increases the air pressure according to the pressurizing portion disposed around the bottom portion, and enlarges the space for containing the airflow, increases the air quantity, smoothes the airflow and thus decreases the turbulence according to the guiding portion on the inner wall of the housing. Compared with the prior art, the fan and the fan frame thereof according to the invention can effectively increase the air pressure and the air quantity of the fan and thus enhance the heat dissipating efficiency without enlarging the size of the fan.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan frame, comprising:

a housing having an air inlet, an air outlet and a circular passage connected between the air inlet and the air outlet, wherein an inner wall of the circular passage is formed with at least one guiding portion in the form of a curved cavity;

a base disposed in the housing and having a bottom portion and a pressurizing portion disposed around the bottom portion; and at least one supporting element disposed between the housing and the pressurizing portion of the base, wherein the pressurizing portion has a free end and a connecting end opposite to the free end, the connecting end of the pressurizing portion is substantially flushed with the outlet for adjusting an airflow intake, or the connecting end of the pressurizing portion sinks into and is dispensed within the housing and thus is located far from the outlet by a buffer depth.

2. The fan frame according to claim 1, wherein the connecting end is connected to the bottom portion, and a cross-sectional area of the free end is unequal to that of the connecting end.

3. The fan frame according to claim 2, wherein the cross-sectional area of the connecting end is greater than that of the free end.

4. The fan frame according to claim 1, wherein a cross section of the pressurizing portion comprises a tilted surface or a curved surface.

5. The fan frame according to claim 1, wherein the guiding portion is a slot or a curved slot.

6. The fan frame according to claim 1, wherein the housing further has at least one curved cavity disposed on an outer sidewall of the housing, and the curved cavity and the guiding portion are disposed alternately.

7. The fan frame according to claim 1, wherein the supporting element is connected to the guiding portion and the supporting element and the guiding portion coordinately form a continuously smooth curved shape or the supporting element and the guiding portion are disposed correspondingly and coordinately form a discontinuously curved shape.

8. The fan frame according to claim 1, wherein the housing, the bottom portion, the pressurizing portion, the guiding portion and the supporting element are integrally formed as a single unit.

9. A fan, comprising:

a fan frame having a housing, a base and at least one supporting element, wherein the base is disposed in the housing and has a bottom portion and a pressurizing portion disposed around the bottom portion, and the supporting element is disposed between the housing and the pressurizing portion of the base; and an impeller disposed in the housing and supported by the base;

wherein the pressurizing portion has a free end and a connecting end opposite to the free end, the connecting end is connected to me bottom portion, and a cross-sectional area of the free end is unequal to that of the connecting end.

10. The fan according to claim 9, wherein the housing has an inner wall formed with at least one guiding portion in the form of a curved cavity.

11. A fan, comprising:

a fan frame having a housing, a base and at least one supporting element, wherein the housing has an air inlet, an air outlet and a circular passage connected between the air inlet and the air outlet, wherein an inner wall of the circular passage is formed with at least one guiding portion in the form of a curved cavity, the base is disposed in the housing, and the supporting element is disposed between the housing and the base; and an impeller disposed in the housing and supported by the base;

wherein the base has a bottom portion and a pressurizing portion disposed around the bottom portion, the pressurizing portion has a free end and a connecting end opposite to the free end, the connecting end is connected to the bottom portion;

wherein the connecting end of the pressurizing portion is substantially flushed with the outlet for adjusting an airflow intake, or the connecting end of the pressurizing portion sinks into and is disposed within the housing and thus is located far from the outlet by a buffer depth.

12. The fan according to claim 11, wherein the supporting element is connected to the housing and the pressurizing portion of the base.

13. The fan according to claim 12, wherein the supporting element is connected to the guiding portion, and the supporting element and the guiding portion coordinately form a continuously smooth curved shape, or the supporting element and the guiding portion are disposed correspondingly and coordinately form a discontinuously curved shape.

14. The fan according to claim 12, wherein the housing, the bottom portion, the pressurizing portion, the guiding portion and the supporting element are integrally formed as a single unit.

15. The fan according to claim 11, wherein a cross-sectional area of the free end is unequal to that of the connecting end.

16. The fan according to claim 11, wherein the impeller has a hub and a plurality of blades disposed around the hub, and a cross-sectional area of the hub is substantially equal to that of the free end of the pressurizing portion.

17. The fan according to claim 11, wherein a cross section of the pressurizing portion comprises a tilted surface or a curved surface.

18. The fan according to claim 11, wherein the guiding portion is a slot or a curved slot.

19. The fan according to claim 11, wherein the housing further has at least one curved cavity disposed on an outer sidewall of the housing, and the curved cavity and the guiding portion are disposed alternately.

* * * * *